US006541685B2

(12) United States Patent
Meinl

(10) Patent No.: US 6,541,685 B2
(45) Date of Patent: Apr. 1, 2003

(54) CONGA STAND

(75) Inventor: Reinhold Meinl, Neustadt/Aisch (DE)

(73) Assignee: Roland Meinl Musikinstrumente GmbH & Co., Neustadt/Aisch (DE)

( * ) Notice: Subject to any disclaimer, the term of this patent is extended or adjusted under 35 U.S.C. 154(b) by 0 days.

(21) Appl. No.: 09/887,162

(22) Filed: Jun. 25, 2001

(65) Prior Publication Data

US 2002/0011141 A1 Jan. 31, 2002

(30) Foreign Application Priority Data

Jul. 28, 2000 (DE) ..... 100 36 841

(51) Int. Cl.[7] ..... G10D 13/02

(52) U.S. Cl. ..... 84/421; 84/327; 84/419; 84/411 R

(58) Field of Search ..... 84/421, 327, 422.3, 84/419, 411 R

(56) References Cited

U.S. PATENT DOCUMENTS

| | | | | |
|---|---|---|---|---|
| 5,739,449 A | | 4/1998 | Torres, Jr. | |
| 6,031,170 A | * | 2/2000 | Hoshino | 84/422.2 |
| 6,040,514 A | * | 3/2000 | Liao | 248/127 |

FOREIGN PATENT DOCUMENTS

| | | |
|---|---|---|
| DE | 40 06 484 | 9/1991 |
| DE | 295 00 540.8 | 4/1995 |
| DE | 199 04 457 | 8/1999 |

* cited by examiner

*Primary Examiner*—Shih-Yung Hsieh
(74) *Attorney, Agent, or Firm*—Browdy and Neimark, P.L.L.C.

(57) ABSTRACT

In a conga stand comprising a holding ring for a conga to be inserted and holding pieces joined on the holding ring and resting laterally on the conga as well as legs equally connected to the holding ring, it is provided that each leg, at its lower end, has a cranked section which is parallel to the ground it stands on and is provided with a non-slip cover, in particular of rubber or the like.

3 Claims, 1 Drawing Sheet

FIG. 1
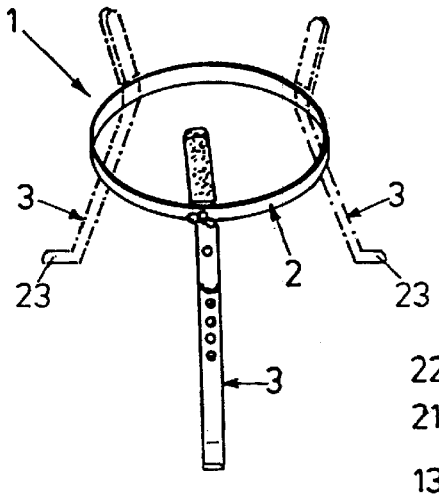
FIG. 2
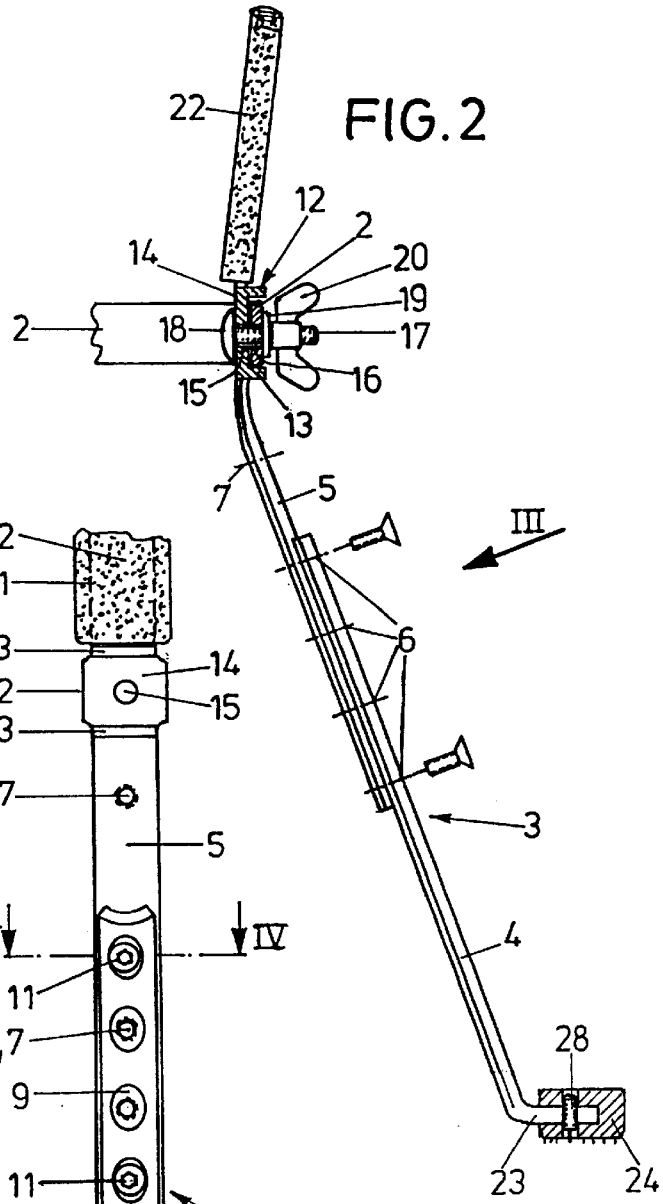
FIG. 5
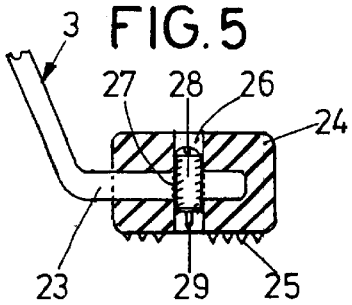
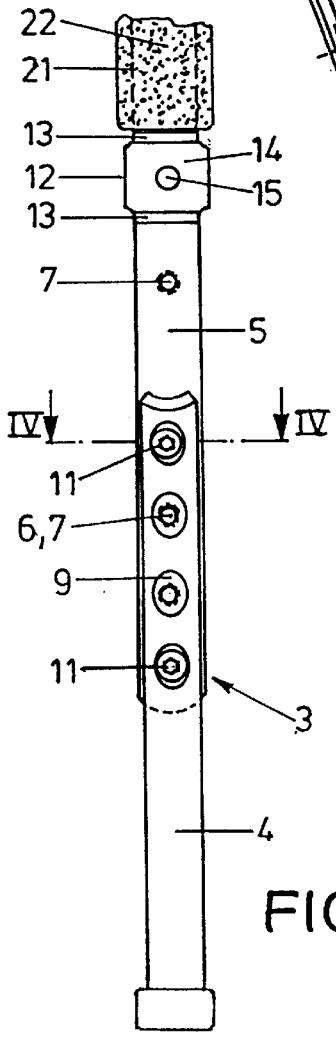
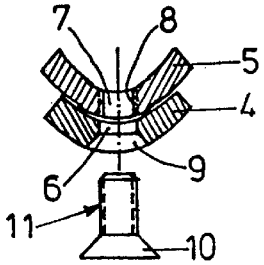
FIG. 4
FIG. 3

CONGA STAND

BACKGROUND OF THE INVENTION

1. Field of the Invention

The invention relates to a conga stand comprising a holding ring for a conga to be inserted and holding pieces joined on the holding ring and resting laterally on the conga as well as legs equally connected to the holding ring.

2. Background Art

Conga stands of the generic type are used in particular for congas of some size. Conga stands come in numerous and varying designs, with comparatively complicated embodiments resulting from the desire to make one and the same conga stand suitable for congas of the most varying dimensions.

As a result of the complexity of some prior art constructions, these conga stands will be comparatively expensive, and quite a few musicians do not even make use of the all-purpose character of the known constructions, it being their wish to use a certain stand only for a certain conga.

A conga stand of the generic type is known from DE 295 00 540 U. It has been extraordinarily successful in practice. A certain drawback resides in that the legs and the cover of the legs stand on the ground approximately by point contact, which, when someone plays the conga, works in favor of a certain migrating motion of the legs as they vibrate from intrinsic flexibility.

SUMMARY OF THE INVENTION

It is an object of the invention to further develop a conga stand of the type mentioned at the outset so that its stability on any ground it stands on is clearly improved.

According to the invention, this object is attained by each leg, at its lower end, having a cranked section which is substantially parallel to the ground it stands on and is provided with a non-slip cover, in particular of rubber or the like.

The enlarged surface resulting there from, combined with the non-slip cover, help prevent the hopping effect on the legs occasioned by vibrations when the conga is played which sum up, resulting in a migrating motion.

By advantage, the underside of the cover is provided with a tread.

Another significant increase in stability on certain floors is attained by the cranked section having a threaded hole which a screw is screwed in; the screw has a spike at its lower end and can be moved, in particular screwed, downwards to project beyond the underside of the cover or tread. Correspondingly, the stand may virtually be anchored on a floor by way of these spikes, which can be withdrawn if desired for gentle treatment of floors that are susceptible to damaging.

BRIEF DESCRIPTION OF THE DRAWING

FIG. 1 is a perspective view of a conga stand according to the invention;

FIG. 2 is a lateral view of a leg of the conga stand with a holding ring partially cut off;

FIG. 3 is a plan view of a leg in the direction of the arrow III of FIG. 2;

FIG. 4 is a section along the line IV—IV in FIG. 3; and

FIG. 5 is a section through the portion of the lower end of a leg.

DESCRIPTION OF THE PREFERRED EMBODIMENT

A conga stand 1 seen in the drawing comprises a holding ring 2 on which three legs 3 are mounted.

Each leg 3 comprises a lower section 4 and an upper section 5 which—as seen in FIG. 4—are bent in a direction perpendicular to their longitudinal extension, having the same radius of curvature so that they can be fitted together while overlapping telescopically. The upper and the lower section 5 and 4 have a series of equidistant drilled holes 6 and 7; the drilled holes 7 of the upper section 5, which in use is the underlying section, have an internal thread 8 and the drilled holes 6 of the lower section 4, which in use lies on top, have a conical section 9 for accommodation of the head 10 of a screw 11 the external thread of which can be screwed into the internal thread 8 of each drilled hole 7.

By telescoping displacement of the sections 4 and 5 one relative to the other, the height of each leg 3 can be regulated, the at least two drilled holes 6 and 7 being movable to coincide so that a position thus adjusted can be fixed by means of two screws 11. The insertion of the screws 11 and the curvature of the sections 4 and 5 help obtain a stable, non-warping construction.

The upper section 5 of each leg 3 comprises a holding member 12 in the shape of a U, the legs 13 of the U enclasping the holding ring 2.

The bight 14 of the U of each holding member 12 is provided with a drilled hole 15 which is in alignment with a corresponding drilled hole 16 in the holding ring 2 so that a screw 17 can be pushed through from the inside of the holding ring 2 sufficiently far for the head 18 of the screw 17 to rest on the inside of the bight 14 of the U; then a shim 19 and a fly nut 20 are placed, or screwed, from outside on the screw 17. Tightening the fly nut 20 provides for a stable assembly of the leg 3 and the holding ring 2.

The upper section 5 of each leg 3 has a joined-on holding piece 21 with a bearing pad 22; as seen in FIGS. 1 and 2, the legs 3 extend externally downwards from the holding ring 2 and the holding pieces 21 joined on extend externally upwards so that a hopper-type area is created, where the conga can be inserted and retained by clamping frictional engagement.

Each leg 3 has a cranked section 23 at its lower end, the cranked section 23 being parallel to the ground on which it is placed and provided with a rubber cushion 24 which has a tread 25 on its underside.

The rubber cushions 24 are provided with a recess 26, which is in alignment with a threaded hole 27 in the cranked section 23 of the leg 3. A headless screw 28 is screwed into the threaded hole 27, having a spike 29 at its lower end. The headless screw 27 can be screwed for this spike to project beyond the tread 25 on the underside, which will reliably prevent the conga stand from being displaced when the conga is played.

What is claimed is:

1. A conga stand comprising a holding ring for a conga to be inserted and holding pieces joined on the holding ring and resting laterally on the conga as well as legs equally connected to the holding ring, wherein each leg (3), at its lower end, has a crank section (23) which is substantially parallel to the ground it stands on and is provided with a non-slip cover, wherein the cranked section (23) has a threaded hole (27) which a screw (28) is screwed in, the screw (28) having a spike (29) at its lower end and being movable to project downwards beyond the underside of the cover (24) and the tread (25).

2. A conga stand according to claim 1, wherein the cover on the underside is provided with a tread (25).

3. The conga stand of claim 1 wherein said non-slip cover is of rubber.

* * * * *